United States Patent [19]

Wada

[11] Patent Number: 4,590,881

[45] Date of Patent: May 27, 1986

[54] SEWING MACHINE AND METHOD OF SEWING PATTERNS

[75] Inventor: Fumio Wada, Tokyo, Japan

[73] Assignee: Tokyo Juki Industrial Co., Ltd., Chofu, Japan

[21] Appl. No.: 776,895

[22] Filed: Sep. 17, 1985

[30] Foreign Application Priority Data

Sep. 28, 1984 [JP] Japan ..... 59-204271

[51] Int. Cl.[4] ..... D05B 3/02

[52] U.S. Cl. ..... 112/456; 112/266.1

[58] Field of Search ..... 112/456, 453, 457, 458, 112/454, 455, 121.12, 262.1, 266.1

[56] References Cited

U.S. PATENT DOCUMENTS 4,116,144 9/1978 Tanimoto et al. ..... 112/457

4,141,305 2/1979 Takenoya et al. ..... 112/456

4,222,339 9/1980 Iwako .

4,227,472 10/1980 Bergvall .

*Primary Examiner*—Peter Nerbun

*Attorney, Agent, or Firm*—Yount & Tarolli

[57] ABSTRACT

A sewing machine for stitching a stitch pattern having a predetermined shape in accordance with stitch pattern data, comprising a memory circuit for storing an initial value indicating the needle swing position for stitch start, a basic stitch number indicating the stitch number required for the formation of one pattern, and quantity of needle swing every stitch pattern, a counter in which the high-order digit portion and the low-order digit portion have the same number of digits, and a control circuit for setting said basic needle number into the low-order digit portion of said counter, adding logic value "1" to each digit of the low-order digit portion, determining a needle swing position in accordance with the arithmetic data, and conducting automatic stitch of said stitch pattern in accordance with the needle swing position thus determined.

4 Claims, 8 Drawing Figures

Fig. 7

| LC2 | LC1 | |
|---|---|---|
| 0 0 0 0 | 0 1 0 1 | |
| | 1 1 1 1 | |
| 0 0 0 1 | 0 1 0 0 | A |
| | 1 1 1 1 | |
| 0 0 1 0 | 0 0 1 1 | B |
| | 1 1 1 1 | |
| 0 0 1 1 | 0 0 1 0 | C |
| | 1 1 1 1 | |
| 0 1 0 0 | 0 0 0 1 | D |
| | 1 1 1 1 | |
| 0 1 0 1 | 0 0 0 0 | E |
| 0 0 0 0 | 0 1 0 1 | 36 |

SEWING MACHINE AND METHOD OF SEWING PATTERNS

BACKGROUND OF THE INVENTION

The present invention relates to a sewing machine and, more particularly, to a sewing machine for sewing stitch patterns.

Heretofore, sewing machines of this type have been provided with needle swing cams and work piece feeding cams corresponding to stitch patterns. The operator has selected specified cams for respective stitch patterns to be sewn. Accordingly, complicated stitch patterns have needed cams having a complicated shape which needs a complicated production process with a lower efficiency. The prior art sewing machines have been disadvantageous also in that the operator has to select specified cams for different stitch patterns.

SUMMARY OF THE INVENTION

It is therefore an object of the present invention to provide a stitch pattern sewing machine which enables the operator to set stitch pattern data with ease and eliminates the need of producing specified cams for different stitch patterns, thus enabling an easy operation.

The present invention is characterized by a stitch pattern sewing machine comprising a memory circuit for storing as stitch pattern data an initial value indicating needle swing position upon start of stitch, a basic stitch number indicating the number of stitches for the formation of one stitch pattern and quantity of needle swing required for the formation of one stitch pattern, a counter in which the high-order digit portion and the low-order digit portion have the same number of digit, an instruction circuit for instructing stitch pattern to be sewn, a first means for reading from said memory circuit said stitch pattern data corresponding to the instruction from said instruction circuit, a second means for setting said basic stitch number at the low-order digit portion of said counter in accordance with data from said first means, a third means for adding logic value "1" to each digit of the value of said low-order digit portion and cycling the operation when the contents of said low-order digit portion become zero, and a fourth means for setting at least two different needle swing positions in accordance with the results of the operation of said third means.

In accordance with the present invention, a memory circuit for storing as data for each stitch pattern an initial value, basic stitch number and quantity of needle swing and an arithmetic and logic circuit having a high-order digit portion and low-order digit portion both having the same number of digits are provided. With such an arrangement, the basic stitch number is set at the low-order digit portion, and logic value "1" is added to each digit. When the result of the addition is a value other than zero, the needle swing position is set at the initial value. When the result of the addition is zero, the needle swing position is set at the position displaced from the last needle position by the quantity of needle swing stored. In this manner, predetermined stitch patterns are automatically sewn. Accordingly, data for each stitch pattern can be easily set. Furthermore, the present invention has excellent effects that unlike the prior art sewing machine it eliminates the need of producing specified cams for different stitch patterns and enables an easy operation.

BRIEF DESCRIPTION OF THE DRAWINGS

FIG. 7 is a diagram illustrating an arithmetic and logic circuit of the embodiment of the present invention.

DETAILED DESCRIPTION OF THE PREFERRED EMBODIMENTS

Figure 1:
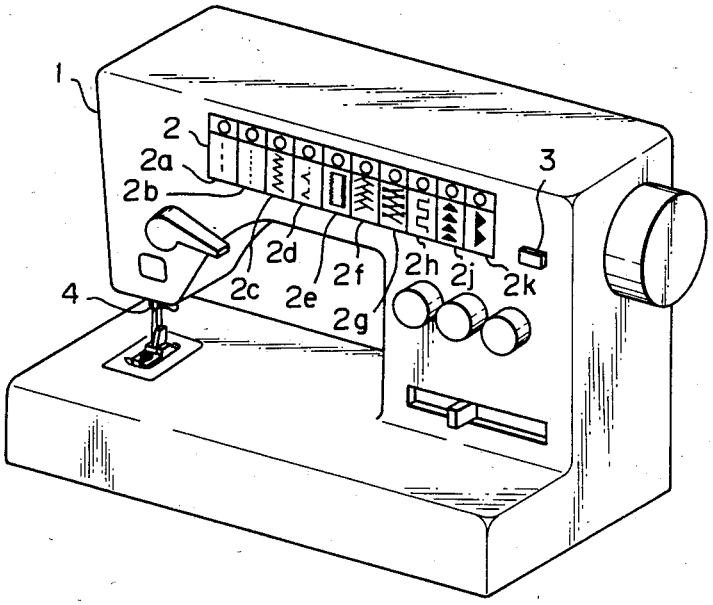
FIG. 1 is a perspective external view of an essential part of an embodiment of the present invention.

An embodiment of the present invention will be described hereinafter by referring to the drawings. FIG. 1 is a perspective external view of the embodiment of the present invention. An arm portion 1 of the sewing machine is provided at its front face with a display panel 2 having a display of stitch patterns 2*a* to 2*k*. Shown at 3 is a pattern selection switch which enables a manual operation of selecting one of stitch patterns indicated by the designs 2*a* to 2*k*. Connected to a needle 4 which is provided in such an arrangement as to swing in directions perpendicular to the direction of work piece feeding is a stepping motor STM for determining the swing position of the needle 4 (see FIG. 2).

Figure 2:
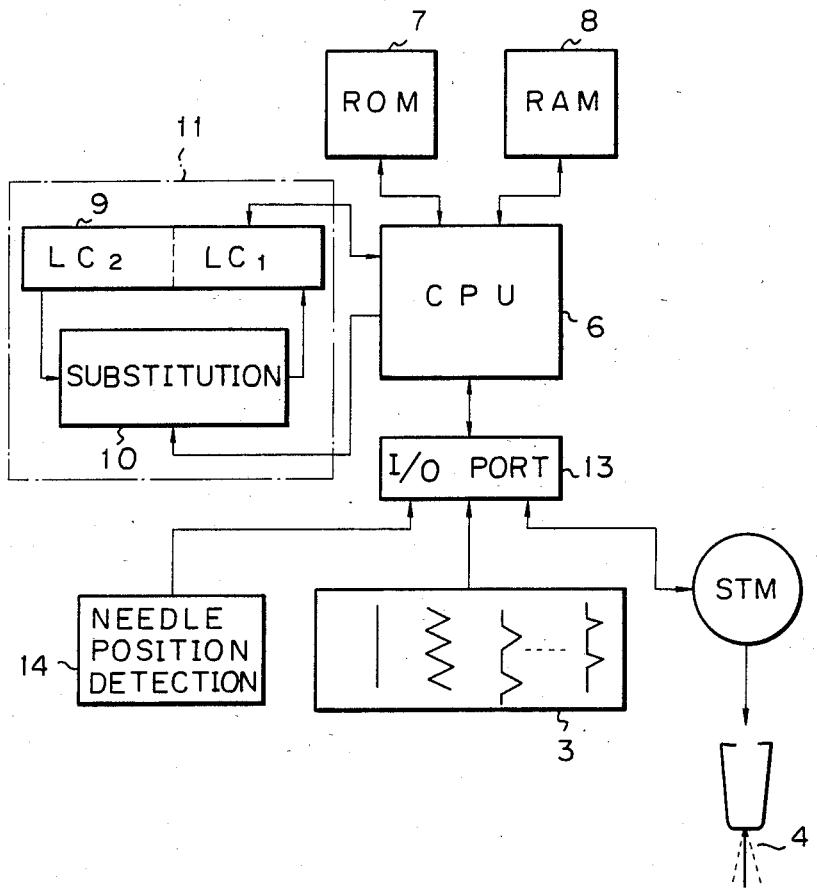
FIG. 2 is a block diagram of an essential part of the embodiment of the present invention.

FIG. 2 shows a block diagram of an essential part of an embodiment of the present invention. Connected to CPU 6 are ROM 7 which stores program for the present sewing machine, RAM 8 which stores stitch pattern data, and an arithmetic and logic circuit 11 consisting of a counter 9 in which the high-order digit portion and the low-order digit portion have the same number of digits (e.g. 4 digits) and a substitution circuit 10 for substituting the value of the high-order digit portion with that of the low-order digit portion and vice versa. Also connected to CPU 6 via I/O port 13 are a needle position detection circuit 14 for detecting the position of the needle 4 synchronous with the upper axis angle, the stitch pattern selection switch 3 and a stepping motor STM (hereinafter referred to as "motor STM") for determining the swing position of the needle 4.

Figure 3:
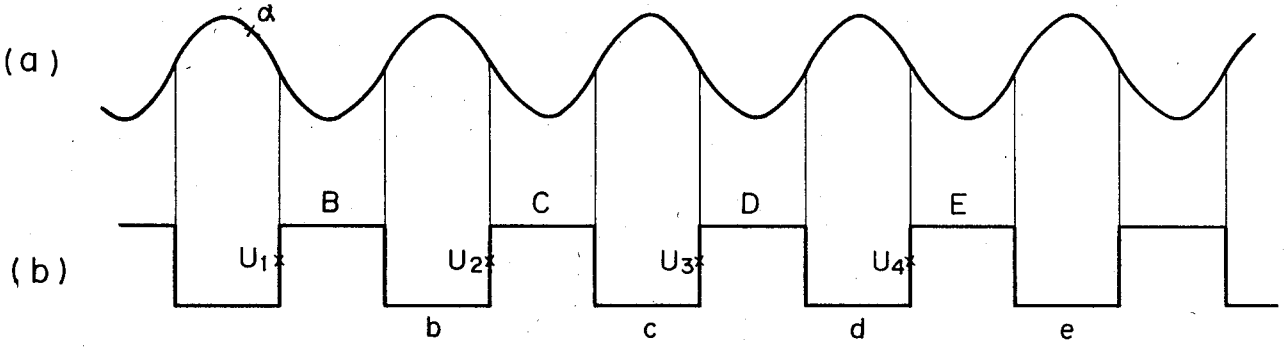
FIG. 3 is a diagram of the waveform of the output of a needle position detection circuit.

FIG. 3 is a view of the waveform of the output signal from the needle position detection circuit 14. The waveform (a) shows a so-called needle locus. The waveform (b) shows an output signal synchronous with the waveform (a). The synchronous signal (b) is outputted at L level signal while the needle 4 is in the needle disengagement state (needle swing period) and as H level signal when the needle 4 is in the needle insertion state (work piece feeding period).

Figure 4A:
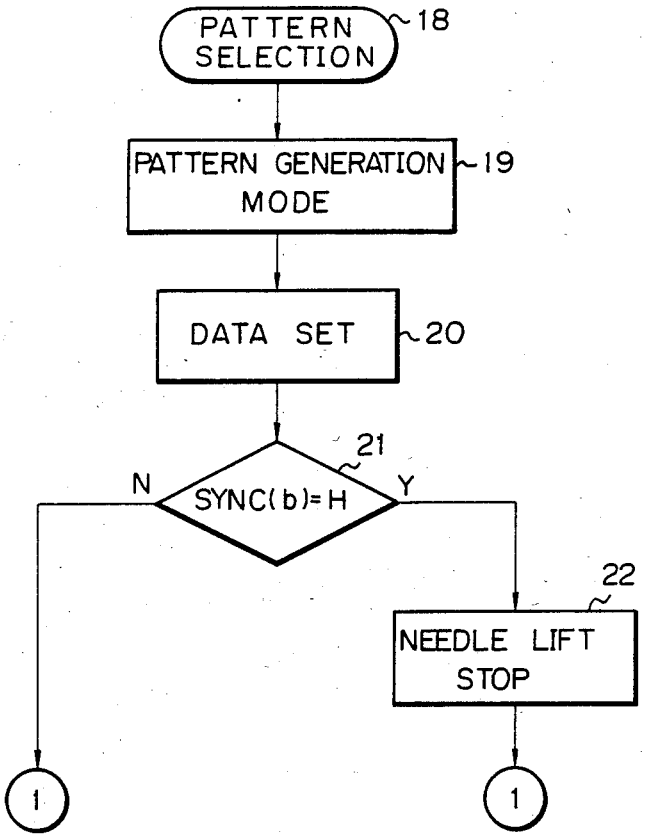
FIGS. 4(*a*), 4(*b*) and 5 are flow charts of the embodiment of the present invention.
Figure 4B:
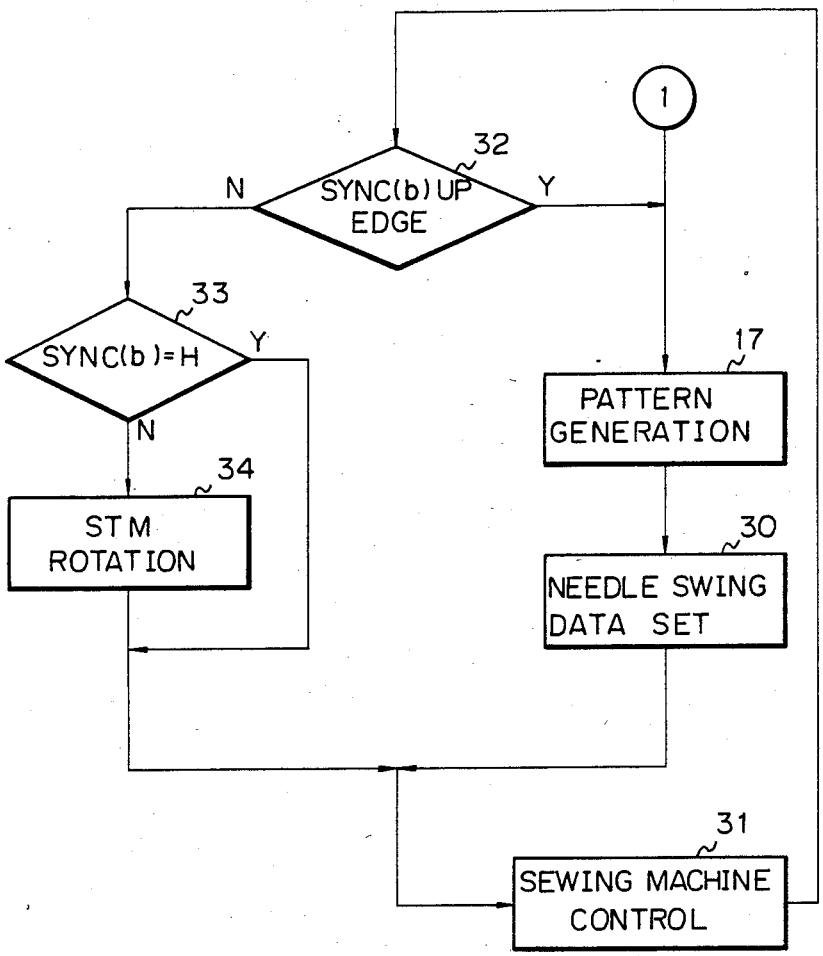
Figure 5:
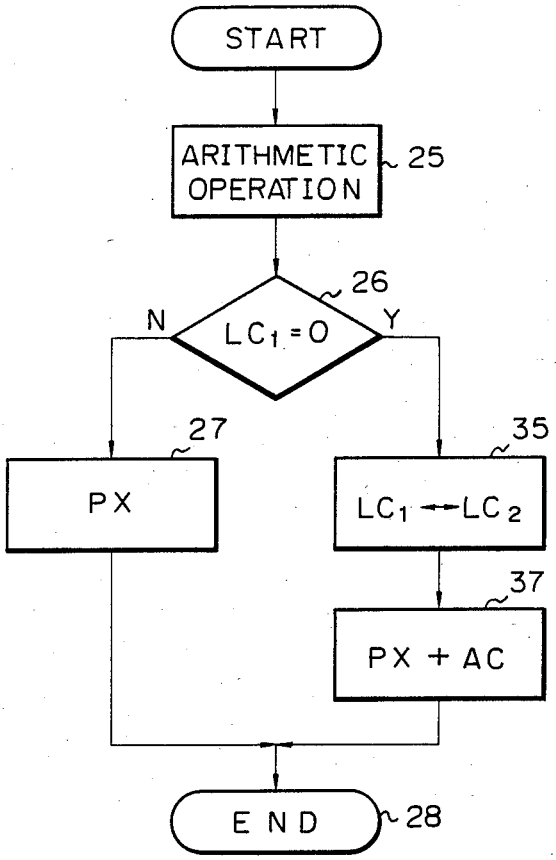

FIGS. 4(*a*) and 4(*b*) are flow charts of the embodiment of the present invention. FIG. 5 shows a flow chart of a pattern generation routine (block 17) shown in FIG. 4(*b*).

Figure 6:
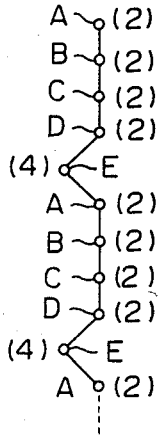
FIG. 6 is a diagram illustrating a predetermined stitch pattern of the embodiment of the present invention.

The characteristic operation of the embodiment of the present invention having the above arrangement will be described hereinafter. Let us now explain the case where the stitch pattern shown in FIG. 6 is selected by the operation of the pattern selection switch 3. The stitch pattern shown in FIG. 6 has a basic pattern formed of the points A to E. That is, the basic needle number LC of the pattern is 5. The figure in the parenthesis in FIG. 6 indicates the needle swing position. That is, the initial value PX of the needle swing position of the stitch start point A of the pattern is 2. The quantity of needle swing AC from the point D to the point E is 2.

The basic needle number LC, the initial value PX and the quantity of needle swing AC have previously been stored in RAM 8 as stitch pattern data for each stitch pattern.

Once the pattern selection is conducted, the program proceeds to the pattern generation mode where the above stitch pattern data LC, PX and AC are read from RAM 8 (see blocks 18, 19, and 20 in FIG. 4(*a*)). At this time, a basic needle number $LC=5_{10}=0101_2$ is set into the low-order digit portion $LC_1$ of the counter 9. CPU 6 then detects the output signal b (hereinafter referred to as "synchronous signal b") from the needle position detection circuit 14. When the synchronous signal b thus detected is at H level, the upper axis is caused to make a half turn so that the needle 4 stops at the needle disengagement section, i.e. the position shown by $\alpha$ in FIG. 3 (see blocks 21 and 22 in FIG. 4(*a*)). On the other hand, when the synchronous signal b is at L level, the needle 4 is at the needle disengagement section and is then caused to remain at the position (see block 21 in FIG. 4(*a*)).

Then the pattern generation routine shown in FIG. 5 is conducted (see block 17 in FIG. 4(*b*)). That is, logic value "1" is added to each digit of the basic needle number $LC=0101_2$ which has been set into the low-order portion $LC_1$ in the arithmetic and logic circuit 11 (see block 25 in FIG. 5). FIG. 7 shows the process of this addition. As a result of this operation, the low-order digit portion $LC_1$ obtains $0100_2$. However, since $LC_1$ is not zero, the initial value PX=2 is outputted as the needle swing position of the point A (see blocks 26, 27 and 28 in FIG. 5).

This needle swing position (2) is held in CPU 6 as the needle swing data of the point A (see block 30 in FIG. 4(*b*)). When the drive switch of the sewing machine is then turned on, it causes the sewing machine to be driven by a known driving mechanism (see block 30 in FIG. 4(*b*)). This causes the needle 4 to be driven in synchronism with the rotation of the upper axis. Similarly, the needle position detection circuit 14 outputs the synchronous signal b in synchronism with the locus of the needle. When the sewing machine is started, the synchronous signal b does not come to an up edge and is at L level (see blocks 32 and 33 in FIG. 4(*b*)). Therefore, CPU 6 determines that the needle is in the needle swing section and then gives the needle swing data (2) of the point A held at the block 30 to the motor STM to set the needle 4 at the needle swing position (2) of the point A (see block 34 in FIG. 4(*b*)). If there is an instruction such as sewing machine operation stop and hold lift in this state, the instruction is processed by a known mechanism not shown (see block 31 in FIG. 4(*b*)).

When an up edge $U_1$ of the synchronous signal b is detected after there is no such instruction or the above instruction is processed, CPU 6 determines that the needle is in the needle insertion section, i.e. work piece feeding section (see block 32 in FIG. 4(*b*)). While the needle is in this work piece feeding section, CPU 6 causes the arithmetic and logic circuit 11 to add logic value "1" to each digit of the low-order digit portion $LC_1$ (see block 17 in FIG. 4(*b*) and block 25 in FIG. 5). The result of the operation is $LC_1=0011_2$ (see B in FIG. 7). However, since $LC_1$ is not zero, PX=2 is outputted as the needle swing position of the point B (see blocks 27 and 28 in FIG. 5 and B in FIG. 3).

This needle swing position (2) is held in CPU 6 as needle swing data of the point B (see block 30 in FIG. 4(*b*)). While the needle is in this needle insertion section, the point A is stitched. When the work piece feeding section is finished and the synchronous signal b is at L level (see blocks 33 and 34 in FIG. 4 (*b*)), the needle swing data (2) of the point B held in clock 30 is given to the motor STM so that the needle 4 is set at the needle swing position (2) of the point B (see block 34 in FIG. 4(*b*) and b in FIG. 3).

The operation described above is repeated thereafter. That is, if up edges $U_2$, $U_3$ and $U_4$ of the synchronous signal b are detected at the block 32, the arithmetic and logic circuit 11 performs an operation of determining the needle swing position of the points C, D and E shown in FIG. 7 during the subsequent respective forwarding section. Since $LC_1$ is not zero at the points C and D, PX=2 is outputted as needle swing data (see blocks 25, 26, 27 and 28 in FIG. 5 and C and D in FIG. 3). The motor STM is driven during the next needle swing section in accordance with the needle swing data so that the needle swing position of the points C and D are determined (see blocks 32, 33 and 34 in FIG. 4(*b*) and c and d in FIG. 3).

If the operation of the arithmetic and logic circuit 11 gives the value of the low-order digit portion $LC_1=0000_2$, CPU 6 identifies this value (see block 26 in FIG. 5). At this time, a basic needle number $LC=5=0101_2$ is formed in the high-order digit portion $LC_2$ (see E in FIG. 7).

After identifying $LC_1=0000_2$, CPU 6 sends a shift pulse to the substitution circuit 10 to substitute the high-order digit portion $LC_2=0101_2$ for the low-order digit portion $LC_1=0000_2$ and vice versa (see block 35 in FIG. 5 and block 36 in FIG. 7). PX+AC=2+2=4 is outputted as needle swing data of the point E (see blocks 37 and 28 in FIG. 5 and E in FIG. 3). The needle swing position of the point E is determined in the same manner as described above in accordance with the needle swing data (4) of the point E (see blocks 32, 33 and 34 in FIG. 4(*b*) and e in FIG. 3).

The stitching of the points B to E is conducted during the needle insertion section immediately after the needle swing position is determined. The similar operation is repeated hereinafter until the stitching of the predetermined stitch pattern is finished.

In addition, the work piece feeding means, too, is connected to a stepping motor (not shown) so that the amount of work piece feeding can be predetermined. The stepping motor is adapted to be driven in accordance with data stored in a memory or data obtained as a result of a known arithmetic operation or the needle swing quantity calculation operation in response to the detection of the up edge U.

What is claimed is:

1. A sewing machine for stitching a stitch pattern having a predetermined shape in accordance with stitch pattern data, comprising:

a memory circuit for storing as said stitch pattern data an initial value indicating the needle swing position for stitch start, a basic stitch number indicating the stitch number required for the formation of one pattern, and quantity of needle swing every stitch pattern;

an arithmetic and logic circuit having a low order digit portion and a high order digit portion;

an instruction circuit for instructing stitch patterns to be stitched;

a first means for reading from said memory circuit said stitch pattern data corresponding to the instruction from said instruction circuit;

a second means for setting said basic stitch number into the low-order digit portion of said arithmetic and logic circuit in accordance with said stitch pattern data from said first means;

a third means for adding logic value "1" to each digit of the low-order digit portion of said arithmetic and logic circuit into which said basic stitch number has been set by said second means, outputting the arithmetic data, repeating said arithmetic operation and, when the result of the arithmetic operation is a predetermined value, cycling said arithmetic operation; and a fourth means for determining at least two different needle swing positions in accordance with the arithmetic data from said third means.

2. A sewing machine as claimed in claim 1, further comprising a needle position detection circuit for detecting the position of the needle of the sewing machine and wherein when the detection signal from said needle position detection circuit indicates the needle insertion section, an arithmetic operation by said third means is conducted and when said detection signal indicates the needle disengagement section immediately following said needle insertion section, a needle swing position is determined by said fourth means and a stitch is conducted during the needle insertion section immediately following said needle disengagement section in accordance with said determined needle swing position.

3. A sewing machine as claimed in claim 1 or 2, wherein said arithmetic and logic circuit comprises a counter in which the high-order digit portion and the low-order digit portion have the same number of digits and a substitution circuit for substituting the value of the low-order digit portion for that of the high-order digit portion and vice versa when the value of the low-order digit portion is zero.

4. In a pattern stitching method of a sewing machine for stitching a stitch pattern having a predetermined shape in accordance with stitch pattern data, said pattern stitching method comprising steps:

a step of storing as said stitch pattern data an initial value indicating the needle swing position for stitch start, a basic stitch number indicating the stitch number required for the formation of one pattern, and quantity of needle swing every stitch pattern;

a step of instructing a stitch pattern to be stitched;

a step of reading said stitch pattern data in accordance with said instruction and setting the basic stitch number contained in said stitch pattern data into the low-order digit portion of an arithmetic and logic circuit;

a step of adding logic value "1" to each digit of the low-order digit portion of said arithmetic and logic circuit into which said basic stitch number has been set, outputting the arithmetic data, repeating said arithmetic operation and, when result of the arithmetic operation is a predetermined value, cycling said arithmetic operation; and a step of determining at least two different needle swing positions in accordance with said arithmetic data.

* * * * *